United States Patent [19]

Howells

[11] Patent Number: 4,805,754

[45] Date of Patent: Feb. 21, 1989

[54] COIN DETECTION DEVICE

[75] Inventor: Geoffrey Howells, Portsmouth, England

[73] Assignee: Kabanos Pty. Limited, Annandale, Australia

[21] Appl. No.: 44,496

[22] PCT Filed: May 1, 1986

[86] PCT No.: PCT/AU86/00119

§ 371 Date: Dec. 30, 1986

§ 102(e) Date: Dec. 30, 1986

[87] PCT Pub. No.: WO86/06264

PCT Pub. Date: Nov. 6, 1986

[30] Foreign Application Priority Data

May 2, 1985 [GB] United Kingdom ..... 8511163

[51] Int. Cl.[4] ..... G07D 5/08

[52] U.S. Cl. ..... 194/317; 194/334

[58] Field of Search ..... 194/317, 318, 334

[56] References Cited

U.S. PATENT DOCUMENTS

| | | | |
|---|---|---|---|
| 3,169,626 | 2/1965 | Miyagawa et al. | 194/317 |
| 4,184,366 | 1/1980 | Butler | 194/317 X |
| 4,667,093 | 5/1987 | MacDonald | 194/334 X |

FOREIGN PATENT DOCUMENTS

| | | | |
|---|---|---|---|
| 0109057 | 5/1984 | European Pat. Off. | 194/317 |
| 2062327 | 5/1981 | United Kingdom | 194/317 |

*Primary Examiner*—F. J. Bartuska

*Attorney, Agent, or Firm*—Ladas & Parry

[57] ABSTRACT

A coin detecting device suitable for use in conjunction with a coin acceptor of a type employed in a gaming or vending machine comprises an inclined channel-shaped track which is formed from an insulating material and along which a coin may roll. Three flat metal plates are located on one side wall of the track, the plates being spaced apart in the direction of movement of the coin down the track and being separated from the coin by the (insulating material) wall of the track. The plates are spaced apart by a distance such that the coin will initially overlap first and second ones of the plates to form a first pair of series capacitors and, thereafter, will overlap the second and third plates to form a second pair of series capacitors. Voltage pulses are applied to the second (intermediate) plate and a detector circuit is connected in circuit with the first and third plates. The detector circuit is arranged to provide an output signal which is indicative of a predetermined increase in the capacitance of the circuits which incorporate the first and second pairs of capacitors responsive to movement of the coin past the pairs of plates.

12 Claims, 5 Drawing Sheets

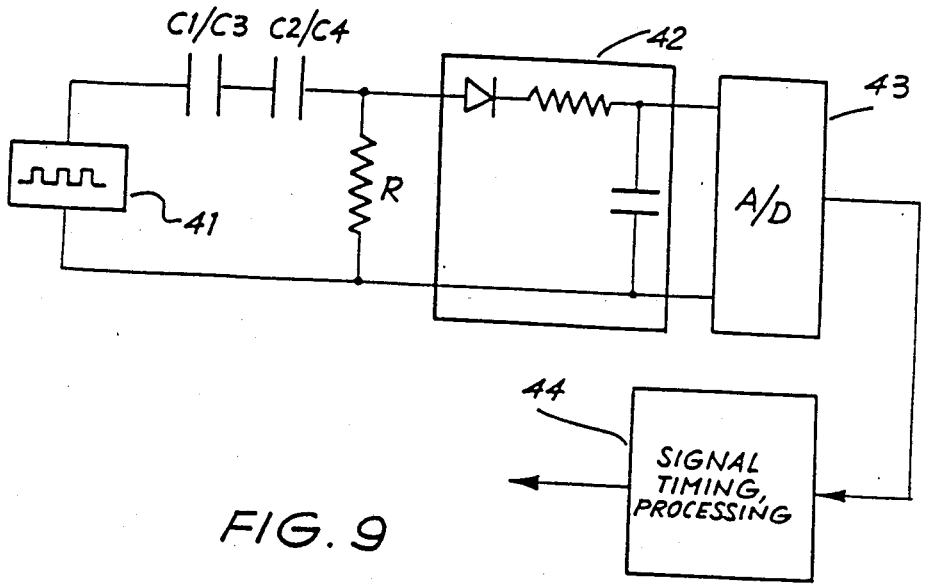
FIG. 9
FIG. 10
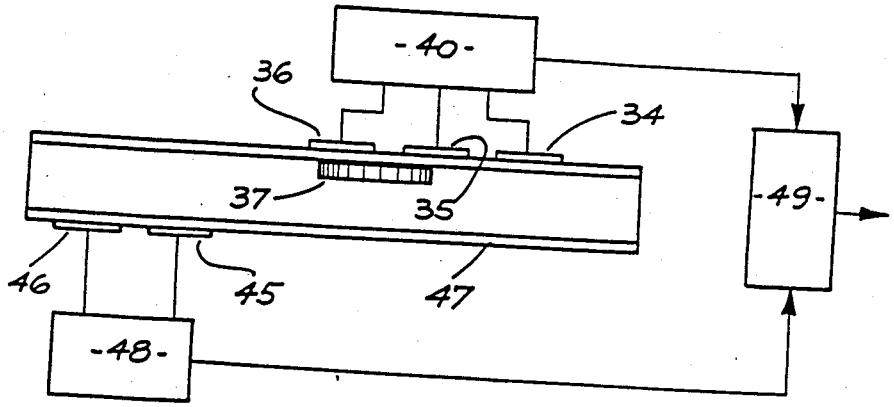

COIN DETECTION DEVICE

TECHNICAL FIELD

This invention relates to a device which is suitable for use in detecting the presence of coins, hereinafter referred to as a coin detecting device. However, the device may be employed for detecting token coins and other currency substitute elements which are formed from metal and it is intended that the word "coin" should be construed to cover all such elements.

In a preferred form of the invention, the coin detecting device functions to discriminate between various coins, that is to discriminate between coins of different denominations or between real and counterfeit coins, and to reject those which are found to be unacceptable. It is proposed that this discrimination be effected by obtaining a measure of the coin's physical dimensions and, if required, by additionally obtaining a measure of the conductivity of the coins.

BACKGROUND ART

Coin detection/acceptor mechanisms currently are used extensively in gaming and vending machines, and they may be categorised broadly as falling within one or two different types, mechanical or electrical. The majority of existing electrical type mechanisms incorporate coils which are located adjacent a coin track and which form parts of tuned circuits which respond to coin passage along the track. Coin detection and discrimination is made as a consequence of a change in the circuit inductance.

These prior art mechanisms are expensive to build and assemble, due to the need for high quality induction coils and other circuit components, and the present invention seeks to provide a mechanism which incorporates a relatively simpler construction.

DISCLOSURE OF INVENTION

Broadly defined, the present invention provides a coin detecting device which comprises a track which is formed at least in part from a non-conductive material and which defines a path along which a coin may move under the influence of gravity. At least two spaced-apart metal plates are located on a wall portion of the track, the plates being disposed so as to be passed one after the other as a coin moves down the track, and the plates being spaced apart by a distance such that the coin will momentarily overlap the or each pair of plates and co-operate with such plates to form two series capacitors as the coin passes the plates. An insulating material covers the plates to prevent electrical contact between the plates and the coin. A pulse generator is provided for applying voltage pulses to one of the plates, and a detector circuit is connected in circuit with the or each other plate. The detector circuit is arranged to provide an output signal indicative of a predetermined increase in the capacitance of the circuit responsive to the movement of a coin past the plates.

In a preferred form of the invention, three spaced-apart metal plates are located on a wall portion of the track, the plates being disposed so as to be passed one after another as a coin moves down the track. The plates are spaced apart by a distance such that the coin will initially overlap first and second ones of the plates to form a first pair of series capacitors and, thereafter, overlap the second and third plates to form a second pair of series capacitors. A pulse generator is provided for applying voltage pulses to the second plate and a detector circuit is connected in circuit with the first and third plates. The detector circuit is arranged to provide an output signal indicative of a predetermined increase in the capacitance of the circuits which incorporate the first and second pair of capacitors responsive to movement of the coin past the pairs of plates.

The coin detecting device most preferably includes circuitry which functions to time the movement of a passing coin over a predetermined distance as it moves along the track and to provide an output signal which constitutes a measure of the diameter of the coin. A measure of the coin's thickness may also be obtained by locating spaced-apart groups of metal plates in opposite side walls of the coin track and by relating the levels of output signals derived from detector circuits associated with the plates in the respective walls of the track.

The detector circuit in each of the above defined arrangements preferably includes a resistive load element which, with the capacitors which are formed by the metal plates and the coin, constitutes an RC timing network. A voltage which appears across the resistive element provides a measure of the (instantaneous) capacitance of the circuit and, therefore, such voltage is applied as an input to processing circuitry for determining a measure of the circuit conditions and, thus, movement of the coin along the track.

The pulse generator preferably provides a high frequency low voltage output, for example, a pulse train having a frequency greater than 10 kHz, and preferably in the order of 100 kHz, and an amplitude in the order of 5 volts.

The coin detecting device would normally be incorporated in a so-called coin acceptor. If the output signal from the device indicates the presence of a valid coin, the acceptor will be gated to accept the coin. Alternatively, if an invalid coin is indicated, the acceptor will be gated to reject the coin. Such coin acceptors are well known in the art and will not be described, other than in general terms, in this specification.

The invention will be more fully understood from the following description of a number of embodiments of the invention which are illustrated by way of example in the accompanying drawings.

BRIEF DESCRIPTION OF DRAWINGS

In the drawings,

FIG. 9 shows a schematic circuit diagram for the second type of coin detecting device of FIGS. 5 and 6, which has circuit elements for measuring movement and dimension of a coin (not shown), and FIG. 10 illustrates a modification of the coin detecting device of FIG. 5, which provides for determination of the thickness of a coin.

MODES FOR CARRYING OUT THE INVENTION

Figure 1:
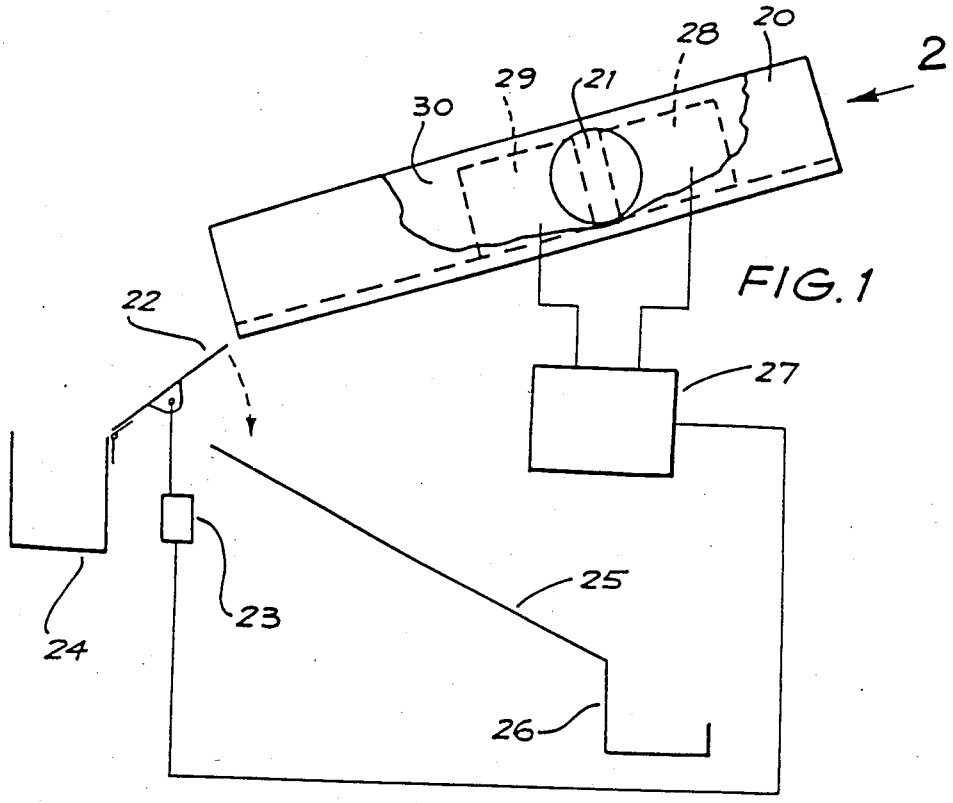
FIG. 1 shows a schematic representation of a coin acceptor mechanism which incorporates a first (simplified) type of detecting device.
Figure 2:
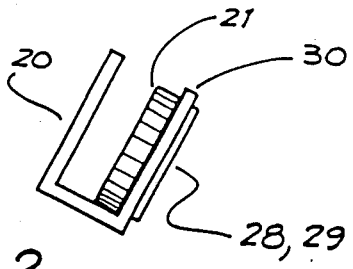
FIG. 2 shows an end view of a track portion of the mechanism of FIG. 1, the view being taken in the direction of arrow 2 in FIG. 1.

As illustrated in FIGS. 1 and 2, the coin acceptor mechanism comprises a channel-shaped track 20 which is formed from a non-conductive material and which defines a path along which a coin 21 may roll under the influence of gravity. The track 20 is aligned with a pivotable gate 22 which is connected to a solenoid 23. When the solenoid is actuated (responsive to the existence of an unacceptable coin on the track) the coin is diverted from its intended path to a bin 24 and is redirected along path 25 to a reject station 26.

The solenoid is energised by a "valid coin" signal which is derived from detecting/processing circuitry 27 which is connected electrically in circuit with two metal plates 28 and 29.

The metal plates 28 and 29 are located on the outside of a side wall 30 of the track 20. The plates are disposed in a plane which lies parallel to the face of the coin 21 as it rolls down the track, and the inside face of the coin is spaced from the surfaces of the plates 28 and 29 by the thickness of the side wall 30 of the track. The track 20 is canted as shown in FIG. 2, to ensure that the inside face of the coin is maintained against the side wall of the track, and, is above mentioned, the track is formed from non-conductive material. Therefore, the coin 21 cooperates with each of the plates 28 and 29 to form a capacitor with each plate. When the coin overlaps the two plates, two series capacitors are formed, with the coin constituting a common (intermediate) plate of the two capacitors.

Figure 3:
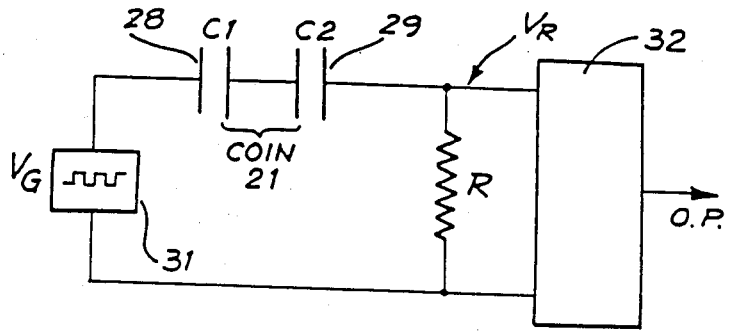
FIG. 3 is a circuit diagram of the electrical elements shown in FIG. 1.

This arrangement is illustrated in FIG. 3 which shows two capacitors C1 and C2 connected in series. Capacitor C1 is constituted by plate 28, the coin 21 and the (dielectric) material which forms the side wall 30 of the track 20. Similarly, capacitor C2 is constituted by plate 29, the coin 21 and the side wall 30 of the track.

In the absence of any coin in the track, negligible capacitance will exist in the circuit of FIG. 3, since the only electrical field between the plates 28 and 29 will be that which fringes the adjacent edges of the plates. However, as the coin 21 rolls past the plates 28 and 29, the capacitance will first increase from a minimum level to a maximum value, which will occur when the coin overlaps both plates by an equal amount, and the capacitance will then reduce to a minimum level as the coin progresses past the plate 29. This condition is shown and is hereinafter decribed with reference to FIGS. 8A and 8B.

Various circuit configurations may be employed for detecting the rise and fall of capacitance, and one such arrangement is shown schematically in FIG. 3.

Figure 4:
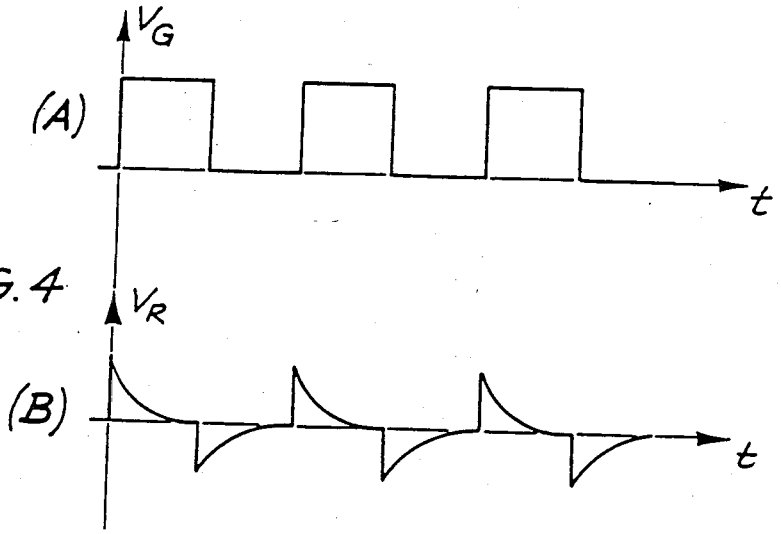
FIG. 4 shows waveforms of voltage pulses which—(A) are applied to the circuit of FIG. 3, and (B) appear across the resistive load in the circuit.

A generator 31 applies high frequency, square-wave, low voltage pulses to plate 28 and a load resistor R is connected to the plate 29. FIG. 4A shows the applied voltage waveform and FIG. 4B shows the resultant voltage pulses which appear across the load resistor R. The shape of the pulses of FIG. 4B is determined by the RC time constant of the circuit, and the amplitude of the pulses shown in FIG. 4B will be proportional to the value of capacitance which exists within the circuit from time to time.

The amplitude of successive ones of the pulses shown in FIG. 4B may be detected in a threshold detector 32 and be compared with predetermined signal levels. If the detected amplitude meets the predetermined levels, the solenoid 23 will be actuated by an output signal from the detector circuit 32 so that the "valid" coin is passed to the bin 24.

Figure 5:
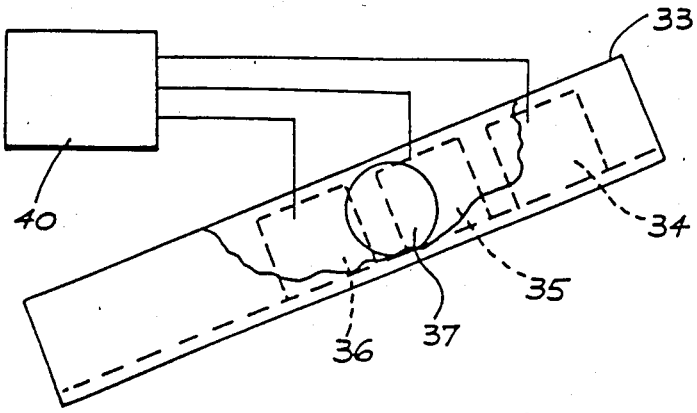
FIG. 5 shows a schematic representation of a second type of coin detecting device.

The arrangement as illustrated in FIGS. 1 to 3 has been described largely to provide an introduction to the coin detecting device as illustrated in FIG. 5 et seq. In fact, it is expected that the arrangement as shown in FIGS. 1 to 3 would not be employed on its own in most situations, but would be used in conjunction with the arrangement of FIG. 5 to check that an inserted coin is not retracted (e.g., by way of a connecting retrieval line) after triggering the arrangement as shown in FIG. 5.

As illustrated in FIG. 5, the coin detecting device includes a channel-shaped track 33 which would normally be incorporated in a coin acceptor mechanism of the type shown in FIG. 1. However, in contrast with the arrangement as shown in FIG. 1, three metal plates 34, 35 and 36 are located in or laminated onto the outside of the wall of the track 33, the plates being disposed so as to be passed one after another as a coin 37 rolls down the track 33.

Figure 7A:
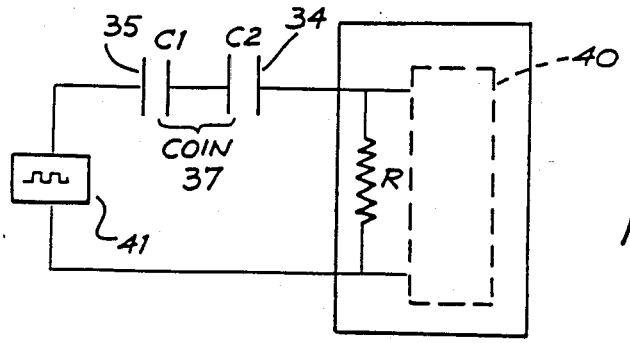
FIG. 7A shows a circuit diagram of the arrangement shown in FIGS. 5 and 6, during the period that the coin is located adjacent first and second ones of the metal plates.

The plates 34, 35 and 36 are spaced apart by a distance such that the coin 37 will initially overlap the first and second plates 34 and 35 to form a first pair of series capacitors C1 and C2 (FIG. 7A). Then, as the coin continues rolling down the track to overlap the second and third plates 35 and 36, a second pair of series capacitors C3 and C4 (FIG. 7B) will be formed.

Figure 6:
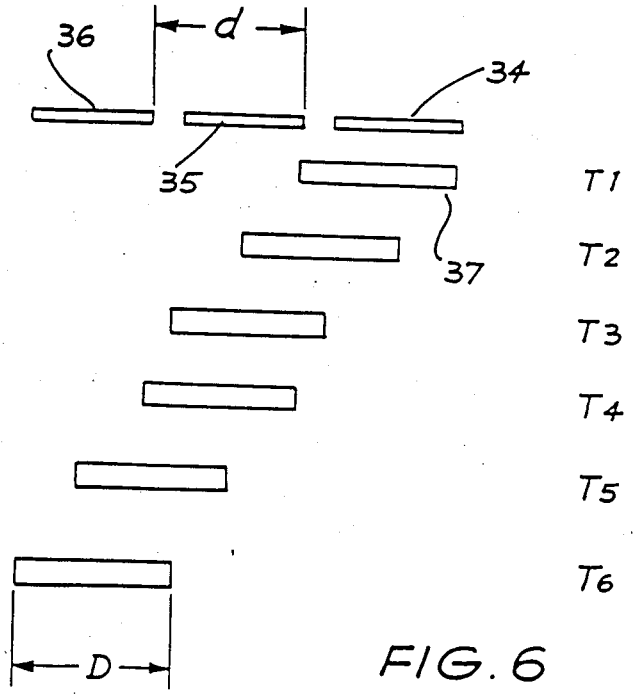
FIG. 6 shows the relative positions of three metal plates which are incorporated in the device of FIG. 5 and the figure shows successive positions of a coin (at incremental intervals of time) as it moves past the plates.

FIG. 6 shows relative positions of the plates 34 to 36 (as viewed from above) and successive positions of the coin 37, at incremental intervals of time, as it moves past the plates.

When the coin is in the first position, at time T1, the leading edge of the coin just overlaps the second plate 35. Then, as the coin rolls to the further position which is reached at T2, the coin overlaps the first and second plates 34 and 35 by an equal amount. At this point in time the total value of capacitance of the series capacitors C1 and C2 should be a maximum.

At time T3, the trailing edge of the coin just overlaps the edge of the first plate 34. At T4, the leading edge of the coin just overlaps the third plate 36, and the trailing edge of the coin just overlaps the corresponding edge of the second plate 35.

At time T5, the coin is positioned to overlap the second and third plates by an equal amount and, finally, at T6, the trailing edge of the coin just overlaps the edge of the second plate 35.

Figure 8A:
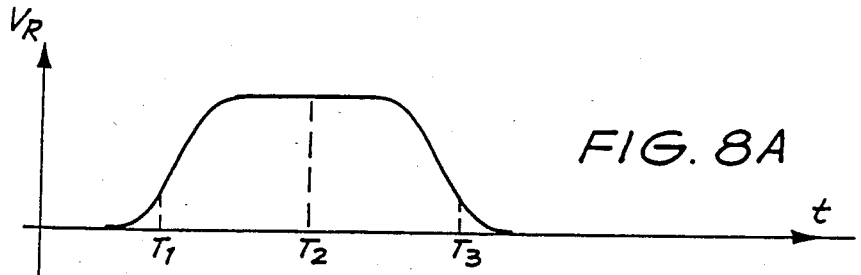
FIG. 8A shows a curve of voltage pulse amplitude against time in relation to the circuit which is illustrated in FIG. 7A.

As the coin moves toward the position which exists at time T2, the capacitance due to C1 and C2 rises toward a maximum and the amplitude of the voltage across resistance R (FIG. 7A) rises to a maximum. Conversely, as the coin advances past the plates and the time progresses beyond T2, the capacitance due to C1 and C2 reduces toward a minimum and the amplitude of the voltage across resistance R decreases to a minimum. This is indicated in FIG. 8A which shows a plot against time of the voltage which appears across the resistance R and which is proportional to the capacitance due to C1 and C2.

Figure 8B:
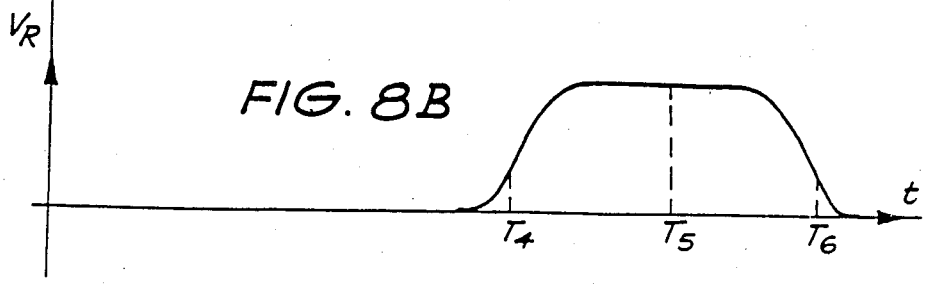
FIG. 8B shows a curve of voltage pulse amplitude against time in relation to the circuit which is illustrated in FIG. 7B.

Similarly, FIG. 8B shows a plot of the voltage which appears across the resistance R and which is proportional to the capacitance due to the existence of capacitors C3 and C4. This plot is applicable to the time period (T6−T4) during which the coin moves past the second and third plates 35 and 36.

If the voltage at times T1, T3, T4 and T6 is assumed to be a (predetermined) threshold voltage, then the time periods which are marked by rises to and falls from the threshold voltage can be measured. Thus, the time period occupied by the coin in moving between the positions occupied at T1 and T4 is equal to (T4−T1), and the time period occupied by the coin in moving between the positions occupied at T3 an T6 is equal to (T6−T3).

Also, if, as will be the case, the distance d between the leading edge of the second plate 35 and the corresponding edge of the third plate 36 is known, the velocity v of the coin can be computed as:

$$\text{Velocity } (v) = d\left(\frac{2}{T4 - T1} + \frac{2}{T6 - T3}\right)$$

Furthermore, by measuring the time taken by the coin in moving from the position occupied at T1 to that which is occupied at T4, that is by measuring the time that the leading and trailing edges of the coin take to pass the same point, the diameter D of the coin may be computed as:

$$\text{Diameter } (D) = v(T4 - T1)$$

Figure 7B:
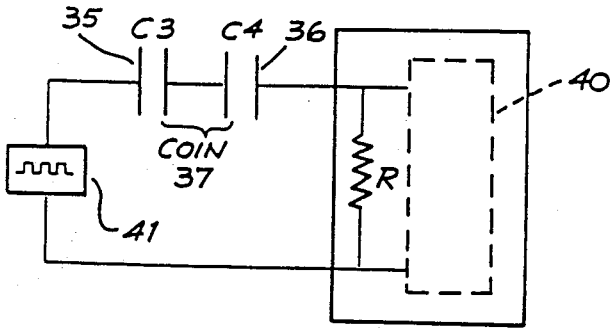
FIG. 7B shows a circuit diagram of the arrangement shown in FIGS. 5 and 6, during the period that the coin is located adjacent second and third ones of the metal plates.

Measures of these parameters may be derived by using various known circuit configurations, and such circuits may be implemented in an integrated circuit chip which is indicated by numeral 40 in FIGS. 7A and 7B. The various circuit elements, including the pulse generator 41, may be mounted on the coin track 33.

One implementation of the circuit is shown schematically in FIG. 9. In this circuit a voltage which appears across the load resistance R is applied to a following diode detector circuit 42. The output of the detector circuit is fed to an analogue-to-digital converter 43 and the output from the converter is fed to a following timing/signal processing circuit 44. The output signals from the circuit 44 provide measures of the velocity and diameter measurements of a coin following its passage through the device.

The detecting device as illustrated in FIG. 5 may be modified, as shown in FIG. 10, to include two further plates 45 and 46 which correspond in size and spacing with the plates 33 and 34. However, the further plates 45 and 46 are located on the opposite side wall 47 of the coin track, they are spaced in a longitudinal direction from the plates 34 and 36, and the further plates 45 and 46 are connected in a circuit 48 which is similar to that shown in FIG. 3.

The arrangement which is shown in FIG. 10 is employed for obtaining a measure of the thickness of the coin 37.

This is derived by obtaining a measure of the maximum capacitance which exists in the circuit 40 as a result of the coin 37 passing, say, plates 34 and 35 and, thereafter, by obtaining a measure of the capacitance in circuit 48 as the coin 37 moves past the plates 45 and 46. Then, by determining the ratio of or the difference between the two capacitance values in a circuit 49 and by comparing the resultant measure with a known (empirically derived) value, a measure may be derived of the coin thickness.

Circuit output signals which are representative of the velocity, diameter and thickness of the coin 37 passing along the track may be applied as inputs to a comparator circuit (not shown) which matches the inputs to stored values and provides a "coin validation" output signal if all inputs are verified as correct or as falling within acceptable ranges. Here again, circuitry which is appropriate for this signal processing is well known and is not further described.

I claim:

1. A coin detecting device which comprises a track which is formed at least in part from a non-conductive material and which defines a path along which a coin can move under the influence of gravity, three spaced-apart metal plates located on a portion of the track, the plates being disposed so as to be passed one after the other as a coin moves down the track and the plates being spaced apart in the direction of movement of the coin by a distance such that the coin will initially overlap first and second ones of the plates to form a first pair of series capacitors and, thereafter, will overlap the second and third plates to form a second pair of series capacitors, an insulating material covering the plates for preventing electrical contact between the plates and the coin, a pulse generator for applying voltage pulses to the second plate, and a detector circuit connected in circuit with the first and third plates, the detector circuit being arranged to provide an output signal indicative of a predetermined change in the capacitance of the circuits which incorporate the first and second pair of capacitors responsive to movement of the coin past the pairs of plates, and the detector circuit including means for timing the period during which the coin travels a predetermined distance as it moves along the track and means for producing a signal which constitutes a measure of the velocity of the coin during its movement over the predetermined distance.

2. A coin detecting device as claimed in claim 1 wherein the detector circuit includes a resistive load element which is connected in circuit with the first and second pairs of series capacitors, and wherein means are provided for detecting a voltage across the resistive element as a measure of the level of capacitance present in the circuit at any given time and for detecting for a predetermined threshold level of the voltage.

3. A coin detecting device as claimed in claim 1 wherein the detector circuit includes further means for timing the period which is occupied for the leading edge and the trailing edge of the coin to pass one predetermined point as the coin travels along the track, and means for providing a signal which constitutes a measure of the diameter of the coin as a function of the velocity of the coin and the time occupied for the leading and trailing edges of the coin to pass the predetermined point.

4. A coin detecting device as claimed in claim 1 wherein the pulse generator produces a square wave pulse train having a frequency greater than 10 kHz.

5. A coin detecting device as claimed in claim 1 wherein the pulse generator and the detecting circuit are mounted to the coin track.

6. A coin detecting device as claimed in claim 1 wherein the coin track is incorporated in a coin acceptor mechanism which includes a gate through which coins are passed if validated by the detecting circuit, and wherein the detector circuit produces an output signal which initiates actuation of the gate.

7. A coin detecting device as claimed in claim 1 wherein the track is canted to one side in order that one face of the coin will bear against the wall on which the three metal plates are located, whereby the coin will be separated from the metal plates by a distance equal to the thickness of the wall of the track.

8. A coin detecting device as claimed in claim 7 wherein the metal plates are disposed in a common plate which lies parallel to the face of the coin as it moves down the track.

9. A coin detecting device as claimed in claim 1 wherein a further pair of metal plates are located on a second wall portion of the track, the second wall portion being opposite that on which the first, second and third metal plates are located, the further plates being disposed so as to be passed one after another as the coin moves down the track, the further plates being spaced apart by a distance such that the coin will momentarily overlap the plates and co-operate therewith to form a third pair of series capacitors as the coin passes the further plates, a detector circuit arranged to provide an output signal representative of the maximum capacitance level of the third pair of series capacitors, a detector circuit arranged to provide an output signal representative of the maximum capacitance of the first and/or second pairs of series capacitors, and means for relating said output signals in a manner such as to produce a signal which provides a measure of the thickness of the coin passing along the track.

10. A coin detecting mechanism as claimed in claim 9 wherein the further plates are separated from the first, second and third plates in the longitudinal direction of the track.

11. A coin detecting device which comprises a track which is formed at least in part from a non-conductive material and which defines a path along which a coin can move under the influence of gravity, at least three spaced-apart metal plates located on a portion of the track, the plates being disposed so as to be passed one after the other as a coin moves down the track and the plates being spaced apart in the direction of movement of the coin by a distance such that the coin will momentarily overlap successive pairs of the plates and co-operate with each such pair of plates to form two series capacitors, an insulating material covering the plates for preventing electrical contact between the plates and the coin, a pulse generator for applying pulses to one of the plates, and a detector circuit which is connected in circuit with each other plate, the detector circuit being arranged to provide an output signal indicative of a predetermined change in the capacitance of the circuit responsive to the movement of the coin past the plates, wherein the detecting circuit includes means for timing the period during which the coin travels a predetermined distance as it moves along the track, and means for producing a signal which constitutes a measure of the velocity of the coin during its movement over the predetermined distance.

12. A coin detecting device as claimed in claim 11 wherein the detector circuit includes further means for timing the period which is coupled for the leading edge and trailing edge of the coin to pass one predetermined point as the coin travels along the track, and means for providing a signal which constitutes a measure of the diameter of the coin as a function of the velocity of the coin and the time occupied for the leading and trailing edges of the coin to pass the predetermined point.

* * * * *